United States Patent [19]

Träubel et al.

[11] 4,106,897

[45] Aug. 15, 1978

[54] LEATHER TANNING WITH OLIGOURETHANES

[75] Inventors: Harro Träubel, Leverkusen, Fed. Rep. of Germany; Helmut Reiff, New Martinsville, W. Va.; Dieter Dieterich, Leverkusen, Fed. Rep. of Germany

[73] Assignee: Bayer Aktiengesellschaft, Leverkusen, Fed. Rep. of Germany

[21] Appl. No.: 718,489

[22] Filed: Aug. 30, 1976

Related U.S. Application Data

[63] Continuation-in-part of Ser. No. 561,809, Mar. 25, 1975, abandoned.

[30] Foreign Application Priority Data

Apr. 4, 1974 [DE] Fed. Rep. of Germany ..... 2416485
Jan. 31, 1975 [DE] Fed. Rep. of Germany ..... 2504081

[51] Int. Cl.[2] ..... C14C 0/00
[52] U.S. Cl. ..... 8/94.33; 8/94.19 R
[58] Field of Search ..... 8/94.19 R, 94.21, 94.33, 8/DIG. 11

[56] References Cited

U.S. PATENT DOCUMENTS

| | | | |
|---|---|---|---|
| 3,374,051 | 3/1968 | Garber | 8/94.21 |
| 3,462,237 | 8/1969 | Sellet | 8/94.21 |
| 3,674,415 | 7/1972 | Sellet | 8/94.33 |
| 3,756,992 | 9/1973 | Dieterich | 260/858 |

FOREIGN PATENT DOCUMENTS

| | | |
|---|---|---|
| 1,223,458 | 6/1960 | France. |
| 1,022,749 | 1/1958 | Fed. Rep. of Germany. |

*Primary Examiner*—John Kight, III
*Attorney, Agent, or Firm*—Gene Harsh; Lawrence S. Pope; Frederick H. Colen

[57] ABSTRACT

This invention is concerned with a method of tanning or retanning leather or pelts by treating them with an aqueous liquor containing water-soluble oligourethanes having ionic groups. The oligourethanes have a molecular weight of from 300 to 20,000 and they may be methylolated. The oligourethanes may be water-soluble owing to their ionic groups or they may contain hydrophilic segments to aid in their solubility in the aqueous liquor. The liquor may also contain up to an equal amount of formaldehyde or compounds which split off formaldehyde.

15 Claims, No Drawings

LEATHER TANNING WITH OLIGOURETHANES

This application is a continuation-in-part of our copending application Ser. No. 561,809 filed Mar. 25, 1975, now abandoned.

FIELD OF THE INVENTION

This invention relates to a new process for treating, i.e. tanning or retanning leather or animal hide or skin using water-soluble oligourethanes.

BACKGROUND OF THE INVENTION

German Patent Specification Nos. 878,544 and 889,349 relate to the coating of split leather or the priming of already tanned leather with solutions of a mixture of alkyd resins which contain free hydroxyl groups and isocyanates as cross-linking agents. These patent specifications, however, give no indication as to any tanning effect of reaction products of polyisocyanates and an excess of hydroxyl compounds.

German Patent Specification Nos. 853,438 and 857,425 describe, among other things, the tanning of leather with dispersions, solutions of vapors of low molecular weight polyisocyanates.

These processes generally produce soft leathers which are in many cases, also lightfast, buth they are unsuitable in practice because of the toxic properties of low molecular weight diisocyanates.

It has now surprisingly been found that high quality products may be produced without the disadvantage of the previously known tanning processes by treating animal pelts or leather which has been retanned in the conventional manner with an aqueous liquor containing water-soluble oligourethanes which contain ionic groups.

SUMMARY OF THE INVENTION

The object of this invention is, therefore, a process for tanning or retanning animal hide or skin or leather, which is characterized in that hide, skin or leather are treated with an aqueous liquor which contains:

(a) optionally methylolated water-soluble ionic oligourethanes which have a molecular weight of from 300 to 20,000; and, optionally, (b) formaldehyde or a substance from which formaldehyde may be split off.

The oligourethanes with a molecular weight of from 300 to 20 000, preferably from 500 to 10 000, used according to the invention generally contain 4 to 120 milliequivalents, preferably 8 to 30 milliequivalents, of ionic groups, based on 100 g solids. They are prepared in known manner from polyisocyanates and polyhydroxyl compounds, optionally in the presence of monofunctional chainterminating agents.

In the context of the present invention, the term "oligourethanes" are defined as compounds having at least two urethane groups, but having no free NCO groups, no aziridine groups and no phenolic groups. The presence of free NCO groups and aziridine groups in tanning agents results in a reduced or shortened pot life of the tanning agents and the presence of phenolic groups in tanning agents results in a reduction of lightfastness of the treated substrate.

The oligourethanes of the present invention may have terminal groups such as OH and/or $NH_2$, but (when prepared in the presence of monofunctional chain-terminating agents) they may also contain no reactive terminal groups at all. Oligourethanes having at least some terminal OH groups are preferred.

DETAILED DESCRIPTION OF THE INVENTION

The polyisocyanates used as starting materials in the preparation of the oligourethanes may be aliphatic, cycloaliphatic, araliphatic, aromatic or heterocyclic polyisocyanates of the type which have been described, e.g. by W. Siefken in Justus Liebigs Annalen der Chemie, 562, pages 75 to 136, for example, ethylene diisocyanate, tetramethylene-1,4-diisocyanate, hexamethylene-1,6-diisocyanate, dodecane-1,12-diisocyanate, cyclobutane-1,3-diisocyanate, cyclohexane-1,3- and -1,4-diisocyanate and mixtures of these isomers, 1-isocyanato-3,3,5-trimethyl-5-isocyanato-methyl-cyclohexane, hexahydrotolylene-2,4- and -2,6-diisocyanate and mixtures of these isomers, hexahydrophenylene-1,3- and/or -1,4-diisocyanate, perhydrodiphenylmethane-2,4'- and/or 4,4'-diiso-cyanate, phenylene-1,3- and -1,4-diisocyanate, tolylene-2,4-and -2,6-diisocyanate and mixtures of these isomers, diphenylmethane-2,4- and/or 4,4'-diisocyanate, naphthylene-1,5-diisocyanate, triphenylmethane-4,4',4''-triisocyanate, polyphenyl-polymethylene-polyisocyanates which may be obtained by aniline-formaldehyde condensation followed by phosgenation and which have been described, e.g. in British Patent Specification Nos. 874,430 and 848,671, the diisocyanates according to U.S. Patent No. 3,492,330, polyisocyanates which contain allophanate groups as described, e.g. in British Patent Specification No. 994,890, Belgian Patent Specification No. 761,626 and published Dutch Patent Application No. 7,102,524, polyisocyanates which contain isocyanurate groups as described, e.g. in German Patent Specification Nos. 1,022,789; 1,222,067 and 1,027,394 and in German Offenlegungsschriften Nos. 1,929,034 and 2,004,048, polyisocyanates which contain urethane groups as described, e.g. in Belgian Patent Specification No. 752,261 or in U.S. Patent No. 3,394,164, polyisocyanates which contain acylated urea groups according to German Patent Specification No. 1,230,778, polyisocyanates which contain biuret groups as described, e.g. in German Patent Specification No. 1,101,394, in British Patent Specification No. 889,050 and in French Patent Specification No. 7,017,514, polyisocyanates prepared by telomerization reactions, e.g. according to Belgian Patent Specification No. 723,640, polyisocyanates which contain ester groups as mentioned, e.g. in British Patent Specification Nos. 956,474 and 1,072,956, in U.S. Patent No. 3,567,763 and in German Patent Specification No. 1,231,688 and reaction products of the above-mentioned isocyanates with acetals according to German Patent Specification No. 1,072,385. Mixtures of the above-mentioned polyisocyanates may also be used. Aliphatic and cycloaliphatic polyisocyanates are preferred because of their lightfastness. Hexamethylene-1,6-diisocyanate, tetramethylene-1,4-diisocyanate, the cyclohexane diisocyanate isomers and 1-isocyanato-3,3,5-trimethyl-5-isocyanatomethyl-cyclohexane are particularly preferred.

Suitable polyhydroxyl compounds for preparing the oligourethanes used according to the invention, apart from short chain polyesters and polycarbonates, are mainly polyethers with a molecular weight of from 100 to 3000, preferably from 100 to 1000, which contain at least 2, generally 2 to 8 but preferably 2 or 3 hydroxyl groups. They may be prepared conventionally, e.g. by polymerizing epoxides, such as ethylene oxide, propylene oxide, butylene oxide, tetrahydrofuran, styrene oxide or epichlorohydrin, each with itself, e.g. in the presence of $BF_3$, or by the addition of these epoxides, optionally as mixtures or successively, to starting components which contain reactive hydrogen atoms, such as water, alcohols, or amines e.g. ethylene glycol, propylene-1,3- or -1,2-glycol, trimethylolpropane, 4,4'-dihydroxydiphenyl-propane, aniline, ammonia, ethanolamine or ethylene diamine. Polyethers modified with vinyl polymers, e.g. the compunds obtained by polymerizing styrene and acrylonitrile in the presence of polyethers (U.S. Patent Nos. 3,383,351; 3,304,273; 3,523,093 and 3,110,695 and German Patent Specification No. 1,152,536) and polybutadienes which contain OH groups are also suitable. Hydrophilic polyethers containing ethylene oxide and/or propylene oxide units are preferred.

Suitable polyesters with hydroxyl groups include, e.g. the reaction products of polyvalent, preferably divalent, alcohols, with the optional addition of trivalent alcohols, and polybasic, preferably dibasic, carboxylic acids. Instead of the free polycarboxylic acids, the corresponding polycarboxylic acid anhydrides or esters with lower alcohols or mixtures thereof may be used for preparing the polyesters. The polycarboxylic acids may be aliphatic, cycloaliphatic, aromatic and/or heterocyclic and may be substituted, e.g. with halogen atoms, and/or may be unsaturated. The following are examples: oxalic acid, malonic acid, succinic acid, adipic acid, suberic acid, azelaic acid, sebacic acid, phthalic acid, isophthalic acid, trimellitic acid, phthalic acid anhydride, tetrahydrophthalic acid anhydride, hexahydrophthalic acid anhydride, tetrachlorohthalic acid anhydride, endomethylene tetrahydrophthalic acid anhydride, glutaric acid anhydride, maleic acid, maleic acid anhydride and fumaric acid. The following, are examples of suitable polyhydric alcohols used either separately or as mixtures: ethylene glycol, propylene-1,2- and -1,3-glycol, butylene-1,4-and -2,3-glycol, hexane-1,6-diol, octane-1,8-diol, neopentylglycol, cyclohexane dimethanol (1,4-bis-hydroxmethylcyclohexane), 2-methyl-1,3-propane-diol, glycerol, trimethylolpropane, hexane-1,2,6-triol, butane-1,2,4-triol, trimethylolethane, pentaerythritol, diethyleneglycol, triethyleneglycol, tetraethyleneglycol, polyethyleneglycols, dipropyleneglycol, polypropyleneglycols, dibutylene glycol and polybutylene glycols. The polyesters may also contain a proportion of carboxylic end groups. Polyesters of lactones, such as $\epsilon$-caprolactone, or hydroxycarboxylic acids, such as $\omega$-hydroxycaproic acid, may also be used. Short chain hydrophilic polyesters (molecular weight from 178 to 3000, preferably from 178 to 1000) are preferred according to the invention.

The polycarbonates with hydroxyl groups used may be those known per se, for example, those which may be obtained by reacting diols, such as propane-1,3-diol, butane-1,4-diol and/or hexane-1,6-diol, ethylene glycol, diethyleneglycol, triethyleneglycol, or tetraethyleneglycol, with diarylcarbonates, e.g. diphenylcarbonate or phosgene. They have a molecular weight of from 150 to 3000, preferably from 150 to 1000. Polyhydroxyl compounds which already contain urethane or urea groups and modified or unmodified natural polyols, such as castor oil, carbohydrates or starch, may also be used.

Representatives of these compounds used according to the invention have been described, e.g. in the High Polymers, Vol. XVI, "Polyurethanes, Chemistry and Technology", published by Saunders-Frisch, Interscience Publishers, New York, London, Volume I, 1962, pages 32–42 and pages 44–54 and Volume II, 1964, pages 5–6 and 198–199 and in Kunststoff-Handbuch, Volume VII, Vieweg-Höchtlen, Carl-Hanser-Verlag, Munich 1966, e.g. on pages 45 to 71.

At least a portion of the polyhydroxyl compounds or polyisocyanate compounds of the type mentioned above or monofunctional and polyfunctional chain-terminating compounds of the type mentioned hereinafter contain ionic groups or functional groups capable of being converted into ionic groups, such as tertiary amino groups, carboxyl groups and sulphonic acid groups, and are incorporated into the oligourethanes of the present invention. By "ionic groups" are meant in particular the following:

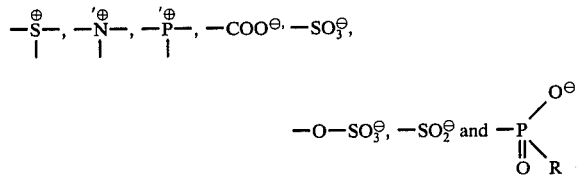

(R = alkyl, cycloalkyl, aralkyl, aryl group with 1 to 10 carbon atoms)

Suitable compounds of this kind and processes for their preparation have been described, e.g. in DOS No. 1,770,068 (U.S. Pat. No. 3,756,992, incorporated herein by reference). Preferably the oligourethanes contain 1 to 3 of the aforementioned ionic groups per molecule.

The oligourethanes may be methylolated in conventional manner by means of formaldehyde, paraformaldehyde, formalin solutions, semiacetals of formaldehyde or other substances which split off formaldehyde, optionally in the presence of basic inorganic or organic methylolating catalysts.

In a preferred embodiment of the invention monofunctional chain-terminating agents are employed to synthesize the oligourethanes to be used in accordance with the invention, such as alcohols, amines, carboxylic acids, or ureas, e.g. methanol, ethanol, propanol, isopropanol, glycol monomethyl ether, dimethyl amine, diethyl amine, methyl amine, ethyl amine, urea, ethylene urea, acetic acid, lactic acid, glycide, 3-hydroxy-methyl-3-ethyl-oxetane, 2-chloro-ethanol, trichloroethanol, 2,3-dibromo-1-propanol, 1-chloro-2-propanol, 1,3-dichloro-2-propanol, acetamide, chloro-acetamide, chloroacetic acid, lauric acid, coconut fatty acid, dodecanic acid, stearic acid, oleic acid, betain, stearyl alcohol or diethylene glycol-monomethyl ether.

Bifunctional or higher functional alcohols, aminoalcohols or amines, which are known to the polyurethane expert under the heading of "chain lengthening agents" can likewise be used as chain-terminating agents to synthesize oligourethanes as long as diisocyanate is used in a stoichiometrically deficient quantity so that these compounds substantially react monofunctionally only. There may be mentioned by way of example: diethylene glycol, triethylene glycol, tetraethylene glycol, dipropylene glycol, thiodiglycol, trimethylol propane, glycerine, amino ethanol, diethanol amine, triethanol amine, N-methyl diethanol amine and the compound $$NH_2—CH_2—CH_2—NH—CH_2—CH_2—SO_3^{\ominus}Na^{\oplus}$$

Mono-isocyanates, e.g. methyl isocyanate, butyl isocyanate or stearyl isocyanate can at the same time be used as chain terminating agents.

In particular such oligourethanes may be used, as are described in German Offenlegungsschriften Nos. 1,770,068 and 1,913,271 (U.S. Pat. No. 3,756,992, incorporated herein by reference), as long as their molecular weight is low enough that they form clear solutions in water.

Oligourethanes which are particularly suitable for use in accordance with the invention contain hydrophilic polyethers, have a molecular weight of about 500 to 3000 and yield a clear or turbid solution on dissolving in water.

The optimum weight ratios of the components in the preparation of oligourethanes are preferably determined empirically while paying regard to the required tanning effect and sufficient liquor stability.

A NCO/OH ratio of about 0.4 to 0.8, preferably 0.5 to 0.7, is maintained when synthesizing oligourethanes from exclusively bifunctional components, e.g. polyethers and diisocyanates in order to achieve the desired low molecular weight. If monofunctional chain terminating agents are simultaneously used, the NCO/OH ratio amounts to about 0.6 to 1.0, preferably 0.7 to 0.9.

The oligourethane tanning substances to be used in accordance with the invention have the particular advantage of being easy to obtain and economic to produce. They can be very simply made from low-costing products prepared on a large scale, e.g. by stirring the components together in vessels at room temperature.

The tanning effect is not dependent on the presence of free or chemically-bonded formaldehyde. However, it is frequently observed that such oligourethanes which exhibit distinct tanning activity without modification with formaldehyde, exhibit still greater tanning activity after formaldehyde modification. It is thus preferred to combine such oligourethanes with formaldehyde.

In addition to the optionally methylolated water-soluble oligourethanes, the aqueous tanning liqours according to the invention may contain from 0 to 100% by weight, preferably from 0.5 to 30% by weight, based on the oligourethane content, of formaldehyde or compounds which split off formaldehyde. It is an advantage of the process according to the invention, however, that the desired tanning effect in many cases may be obtained even without the use of formaldehyde or methylolated products.

According to the invention, the hides, skins and leathers may be treated with the tanning liquor by means of any conventional tanning apparatus, preferably in a drum or in a dyeing machine with Y-shaped, perforated separating walls such as a CORETAN (trademark) machine by USM. Depending on the kind of hide, the tanning agent and the desired tanning effect, the materials are treated with the tanning liquor for about 0.5 hours to about 3 days. The liquors may also be applied by spraying, dipping or curtain coating, however.

It is in advantage of the oligourethanes to be used in accordance with the invention that they are not sensitive against variations of the pH-value. Thus, the liquors may have a pH-value from about 2.5 to 9, preferably 3 to 8 and with particularr preferance from 3.5 to 6.

The oligourethanes also are not sensitive against elevated temperatures. When being used as retanning agents, or dyeing auxiliaries, they therefore may be applied at temperatures of up to about 80° C. On the other hand, since hides and skins must not be heated above their denaturation temperature, tanning has to be carried out at temperatures below about 30° C, preferably at room temperature.

The leathers obtained according to the invention generally have a low specific gravity since the fibers are not heavily loaded with tanning substance.

In contrast to conventionally produced suedes (which they resemble in their properties), the leathers obtained according to the invention may easily be dyed with ordinary eyes. The tanning agents in accordance with the invention act advantageously at the same time as dyeing auxiliaries. The dyeing agents are particularly uniformly absorbed on leather which has been treated with the products in accordance with the invention. No undesired brightening occurs. As the products are lightfast no change in color is to be detected on exposure to light. Leathers which have been tanned according to the invention may be dressed by any conventional dressing methods. They are supple, gentle to the skin, porous, soft, white and lightfast. Since they are white, they may be dyed in brilliant colors.

Unless otherwise stated, the figures quoted in the Examples represent parts by weight and % by weight, respectively.

EXAMPLE 1

(a) Preparation of the oligourethane:

500 g (0,25 mol) of polypropylene glycol and 60.9 g (0,36 mol) of tolylene diisocyanate (2,4 — to 2,6 — isomer ratio = 65:35) are mixed at 70° C and heated for 1 hour to 90° C. The resultant NCO prepolymer (1.9% NCO) is treated at 70° with a solution of 16 g 65% oleum in 60 g dioxane. 30 minutes later, 20 g of triethylamine are added and the reaction stopped by the addition of 8 g of methanol. 10 g of oxethylated nonyl phenol and 1000 g of water, and thereafter 28 g of 37% aqueous formaldehyde solution are added to the clear, NCO-free solution.

(b) Process in accordance with the invention (1) Use as tanning agent alone: A calf pelt, which has been limed and delimed in the usual way, was drummed for 24 hours at 20° C with 100% by weight of water and 10% of oligourethane (dry substance). Thereafter the leather was washed for 10 minutes, fleshed and, without greasing, hung up to dry.

EVALUATION:

The leather has a very soft handle, is full, white in color and very lightfast.

Shrinkage temperature: 90° C (2) Use as retanning agent for chrome leather:

Leather, which has been tanned in the customary manner with trivalent chrome sulphate salts, was treated at 40° C with 100% water and 5% dry substance of the oligourethane.

Drumming time: 2 hours

Thereafter the leather was fat-liquored with 2% of sulphonated neatsfoot oil and then hung to dry.

EVALUATION:

By aftertreatment with the above product, the color of the chrome leather is somewhat brighter and the handle softer and fuller than without such aftertreatment.

Analogous results are obtained when instead of methanol, urea or glycol monomethyl ether are used.

Although the invention has been described in detail in the foregoing for the purpose of illustration, it is to be understood that such detail is solely for that purpose and that variations can be made therein by those skilled in the art without departing from the spirit and scope of the invention except as it may be limited by the claims.

What is claimed is:

1. Process for tanning or retanning hide, skin or leather, characterized in that hide, skin or leather are treated with an aqueous solution which contains:

(a) optionally methylolated water-soluble oligourethanes containing ionic groups which have a molecular weight of from 300 to 20,000, characterized in that the water-soluble oligourethanes contain no phenolic groups, no free NCO groups and no aziridine groups; and, optionally, (b) formaldehyde or a substance from which formaldehyde may be split off.

2. Process according to claim 1, characterized in that the oligourethane molecule contains hydrophilic polyether segments.

3. A process for tanning or retanning a substrate selected from the group consisting of animal pelts and leather comprising treating the substrate with an aqueous solution containing water-soluble oligourethanes containing ionic groups which have a molecular weight ($M_n$) of from 300 to 20,000, characterized in that the water-soluble oligourethanes contain no free NCO groups, no phenolic groups and no aziridine groups.

4. The process of claim 3 wherein the oligourethanes are methylolated.

5. The process of claim 4 wherein the aqueous liquor contains from 0 to 100 wt.% based on the oligourethane of compounds selected from the group consisting of formaldehyde and compounds which split off formaldehyde.

6. The process of claim 5 wherein the formaldehyde supplying compounds are present in amounts of about 0.5 to 30 wt.% based on the oligourethane.

7. The process of claim 3 wherein the oligourethane molecules contain hydrophilic polyether segments.

8. The process of claim 3 wherein the oligourethane molecules contain ionic groups selected from the group consisting of:

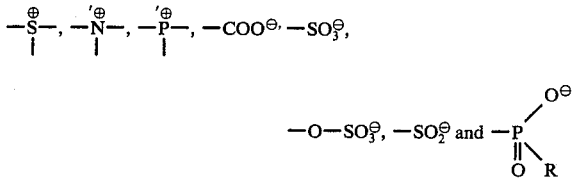

where R is a monovalent alkyl, cycloalkyl, aralkyl or aryl radical.

9. A process for tanning or retanning a substrate selected from the group consisting of animal pelts and leather comprising treating the substrate with an aqueous solution containing water-soluble oligourethanes containing ionic groups which have a molecular weight ($M_n$) of from 300 to 20,000, characterized in that the water-soluble oligourethanes contain no free NCO groups, no phenolic groups and no aziridine groups, said water-soluble oligourethanes synthesized by a process comprising (a) reacting polyhydroxyl compounds selected from the group consisting of polyethers, polyesters and polycarbonates, with (b) polyisocyanates and (c) optionally chain-terminating agents wherein at least a portion of at least one of components (a), (b) and (c) contains at least one ionic group or at least one group which may be converted into an ionic group.

10. The process of claim 9 wherein the NCO/OH ratio maintained during the synthesis of the water-soluble oligourethanes is between 0.4 to 0.8.

11. The process of claim 9 wherein chain-terminating agents selected from the group consisting of polyols, amino alcohols and polyamines are used in the synthesis of the water-soluble oligourethanes and wherein the NCO/OH ratio maintained during the synthesis reaction is between 0.4 to 0.8.

12. The process of claim 9 wherein chain-terminating agents selected from the group consisting of monofunctional alcohols, monofunctional amines, monofunctional carboxylic acids, ureas and monofunctional isocyanates are used in the synthesis of the water-soluble oligourethanes and wherein the NCO/OH ratio maintained during the synthesis reaction is between 0.6 to 1.0.

13. The process of claim 12 wherein the chain-terminating agents are selected from the group consisting of monofunctional alcohols, monofunctional amines, monofunctional carboxylic acids and ureas.

14. The process of claim 9 wherein chain-terminating agents are used in the synthesis of the water-soluble oligourethanes, at least one of said chain-terminating agents selected from the group consisting of polyols, amino alcohols and polyamines and at least one of said chain-terminating agents selected from the group consisting of monofunctional alcohols, monofunctional amines, monofunctional carboxylic acids, ureas and monofunctional isocyanates, and wherein the NCO/OH ratio maintained during the synthesis is between 0.6 to 1.0.

15. The process of claim 9 wherein the polyhydroxyl compounds are polyethers.

* * * * *